United States Patent [19]

Koizumi

[11] 4,136,943

[45] Jan. 30, 1979

[54] VISUAL DISPLAY APPARATUS

[76] Inventor: Yutaka Koizumi, Tokyo, Japan

[21] Appl. No.: 750,780

[22] Filed: Dec. 15, 1976

[30] Foreign Application Priority Data

Dec. 17, 1975 [JP] Japan ..... 50-151032

[51] Int. Cl.[2] ..... G03G 15/00

[52] U.S. Cl. ..... 355/5; 355/16

[58] Field of Search ..... 355/5, 16, 44, 45

[56] References Cited

U.S. PATENT DOCUMENTS

| | | | |
|---|---|---|---|
| 3,168,857 | 2/1965 | Hutto | 355/5 |
| 3,700,328 | 10/1972 | Davidge et al. | 355/15 |
| 3,914,045 | 10/1975 | Namiki et al. | 355/15 |
| 3,936,178 | 2/1976 | Kuehnle | 355/5 |
| 3,955,977 | 5/1976 | Bailey | 355/5 |

OTHER PUBLICATIONS

"Quick Processed Bright Displays by Xerography", G. R. Mott et al., *Photographic Science and Engineering*, vol. 5, No. 2, Mar.-Apr., 1961.

*Primary Examiner*—Richard L. Moses
*Attorney, Agent, or Firm*—Frank J. Jordan

[57] ABSTRACT

An enlarged electrostatic image of an original document such as a microfilm frame is formed on a photoconductive belt and is developed by means of a toner substance to produce a visible image. The belt is then moved to a viewing position where it serves as a screen for displaying the visible image. The belt is discharged and the toner substance removed therefrom after the display in preparation for displaying the image of another microfilm frame on the belt.

5 Claims, 3 Drawing Figures

VISUAL DISPLAY APPARATUS

BACKGROUND OF THE INVENTION

The present invention relates to a visual display apparatus for displaying an enlarged image of an original document such as a microfilm frame.

Various types of optical projectors are currently in widespread use for projecting enlarged images of original documents such as microfilm frames onto a viewing screen. Slide overhead and opaque projectors are typical examples and all operate on the same principle. The original document is illuminated by a light source and an optical system comprising a converging lens focusses an optical image of the document onto a viewing screen.

All of these prior art projectors suffer from the same drawback in that in order to provide an optical image of sufficient brightness for satisfactory viewing the room in which the viewing is being done must be darkened. Whereas systems employing the rear screen projection principle allow viewing in lighted rooms, the size of the image is limited to such an extent that only one or a very few persons can comfortably view the image.

Another major drawback of optical projectors which project an image onto a viewing screen in that the original document is heated by the illumination lamp to such an extent that it may be damaged. This problem is particularly acute in the projection of plastic transparencies, and limits the size and brightness of the projected image. Prolonged viewing increases the possibility of heat damage. Decreasing the intensity of the illumination lamp in order to preclude heat damage of course reduces the intensity of the projected image and further limits the size thereof.

SUMMARY OF THE INVENTION

It is an object of the present invention to provide a visual display apparatus which eliminates the possibility of heat damage to original documents such as slides, images of which are being projected.

It is another object of the present invention to provide a visual display apparatus with increased image size and brightness.

It is another object of the present invention to provide a visual display apparatus which eliminates the necessity of darkening the room in which the apparatus is operated.

It is another object of the present invention to provide a visual display apparatus which produces a developed electrostatic visible image of an original document on a photoconductive belt or the like for viewing, the image being erasable so that the belt may be used for the display of other images in sequence.

It is another object of the present invention to provide a generally improved visual display apparatus.

Other objects, together with the foregoing, are attained in the embodiments described in the following description and illustrated in the accompanying drawings.

DECRIPTION OF THE PREFERRED EMBODIMENTS

While the visual display apparatus of the invention is susceptible of numerous physical embodiments, depending upon the environment and requirements of use, substantial numbers of the herein shown and described embodiments have been made, tested and used, and all have performed in an eminently satisfactory manner.

Figure 1:
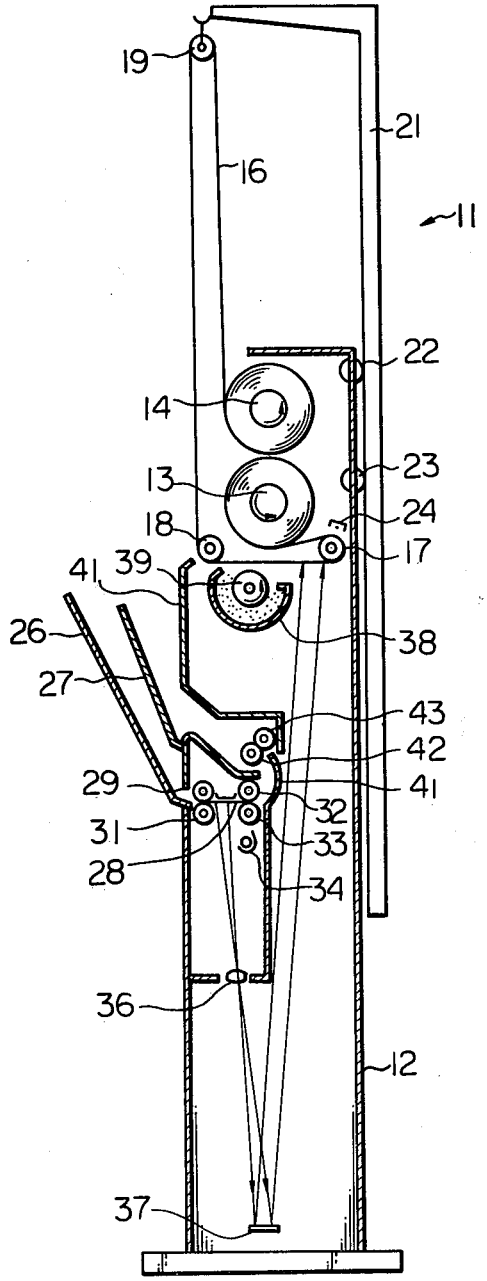
FIG. 1 is an elevational view of a first embodiment of a visual display apparatus according to the present invention.

Referring now to FIG. 1 of the drawing, a visual display apparatus of the invention is generally designated as 11 and comprises a housing 12. A supply roller 13 and a take-up roller 14 are rotatably supported within the housing 12 and a photoconductive belt 16 is wound around the rollers 13 and 14 at its opposite ends respectively. The belt 16 is further trained around idler rollers 17, 18 and 19 which are spaced along the length of the belt 16. The idler rollers 17 and 18 are rotatably supported by the housing 12 in the fixed positions illustrated. The idler roller 19, however, is rotatably supported by a hanger 21 which is vertically slidably mounted on the housing 12 by means of roller bearings 22 and 23. Suitable means such as a clamp (not shown) are provided so that the hanger 21 and therefore the idler roller 19 may be raised to a desired height and clamped in position.

The belt 16 comprises a flexible substrate and a photoconductive layer formed on one surface thereof. The portion of the belt 16 between the idler rollers 18 and 19 is utilized for viewing a visual image as will be described in detail below, and the photoconductive layer is formed on the belt 16 so as to face leftwardly in the viewing position or area between the idler rollers 18 and 19 as shown in FIG. 1.

A corona charging unit 24 is disposed adjacent to the idler roller 17 for electrostatically charging the photoconductive layer of the belt 16. It is important that the housing 12 be configured so as to prevent the belt 16 from being exposed to stray light in the area between the idler rollers 17 and 18.

Whereas the belt 16 after charging by the charging unit 24 will retain the electrostatic potential thereon if not exposed to light for a substantial length of time, the incidence of light thereon will cause photoconduction and dissipation of the electrostatic charge.

The apparatus 11 further comprises guides 26 and 27 formed integrally with the housing 12 which serve to guide an original document 28 into the bite of feed rollers 29 and 31 when the document 28 is inserted between the guides 26 and 27. The feed rollers 29 and 31 feed the document 28 therebetween into the bite of feed rollers 32 and 33. An illumination lamp 34 is disposed so as to illuminate the portion of the document 28 between the feed rollers 29, 31 and 32, 33.

In the illustrated embodiment the original document 28 is opaque and is inserted between the guides 26 and 27 with the side of the document 28 bearing information for display facing downwardly. The information side is therefore illuminated by the lamp 34. A converging lens 36 projects an optical image of the document 28 onto a plane mirror 37 which reflects the image onto the belt 16 as indicated by arrows. The distances between the document 28 and the converging lens 36 and between the converging lens 36 and the belt 16 are selected so that the image of the document 28 is focussed onto the belt 16.

Suitable drive means are provided to rotate the feed rollers 29, 31, 32 and 33 and also the supply roller 13 and take-up roller 14 in a synchronized manner, with all of said rollers being driven counterclockwise. The focal length of the lens 36 is selected so that the image of the original document 28 focussed on the belt 16 thereby will be much larger than the document 28 itself. The drive speeds of said rollers are selected so that the surface speed of the belt 16 is equal to the surface speed of the document 28 multiplied by the image enlargement ratio. This type of scanning operation is well understood by those skilled in the art.

The light image focussed on the belt 16 causes localized photoconduction in such a manner that an electrostatic image of the document 28 will be formed on the belt 16. This image is developed to produce a visible image by a developing unit 38 comprising a rotating magnetic brush 39. The brush 39 comprises a rotating magnetic core surrounded by a cylindrical sleeve formed of non-magnetic material, although these components are not shown in detail or designated by reference numerals. A toner substance comprising, for example, ferromagnetic particles coated with a black colored solidified resin is applied to the core and is magnetically attracted thereto. The toner substance contacts the belt 16 and adheres to the areas of high electrostatic potential due to electrostatic attraction to form a visible toner image of the original document 28 on the belt 16. The rollers 13 and 14 are rotated until the portion of the belt 16 on which the image is formed is spaced between the idler rollers 18 and 19. Movement of the belt 16 is then stopped.

The belt 16 is formed such that the photoconductive layer appears white when no toner substance is adhered thereto. This forms the background of the visual display. Since the electrostatic charge is dissipated in the light image areas and no toner substance adheres thereto, the light image areas will appear white on the belt 16. However, the electrostatic charge is not dissipated in the dark image areas of the belt 16 and the toner substance adheres thereto. Since the toner substance is black in color, the dark image areas of the belt 16 will appear dark when the electrostatic image on the belt 16 is developed.

Although the electrostatic charge on the image portion of the belt 16 is dissipated through exposure to light when the image portion is moved out of the housing 12 to the display position between the idler rollers 18 and 19, enough residual charge will remain to maintain the toner substance adhered to the belt 16. It will be seen that the portion of the belt 16 in the viewing position serves as a screen, and a large number of persons may view the enlarged visual image thereon even in relatively light surroundings. The image will persist for a prolonged period of time after formation, thereby eliminating the need of further illumination of the original document 28 by the lamp 34. Since the document 28 is illuminated for only the short period of time required for scanning or imaging, the possibility of heat damage is positively precluded.

The apparatus 11 further comprises a guide 41 which deflects the leading edge of the document 28 into the bite of feed rollers 42 and 43 which in turn feed the document 28 out of the housing between the guide 27 and a guide portion 44 of the housing 12. In this manner, the original document 28 is fed through the housing 12 for scanning and automatically ejected from the housing 12 after the scanning operation is completed.

After the viewers have viewed the image sufficiently, the rollers 13 and 14 are driven clockwise thereby winding the image portion of the belt 16 back onto the supply roller 13. In passing adjacent to the developing unit 38, the toner substance is removed from the belt 16 by the magnetic brush 39 thereby completely erasing the visible toner image. The belt 16 is then ready for subsequent charging, imaging and development for display of the image of another original document.

It will be noted that another advantage of the present invention is conservation of materials. The belt 16 is reused for the display of thousands of visible images. The toner substance is returned to the developing unit 38 by the magnetic brush 39 and recycled.

The hanger 21 enables the distance between the idler rollers 18 and 19 and thereby the height of the viewing screen to be varied to accommodate original documents of different lengths. Although the original document 28 shown and described with reference to FIG. 1 is opaque, a slide, microfilm frame or the like may be displayed by merely relocating the lamp 34 above the document to illuminate the same from the back.

Figure 2:
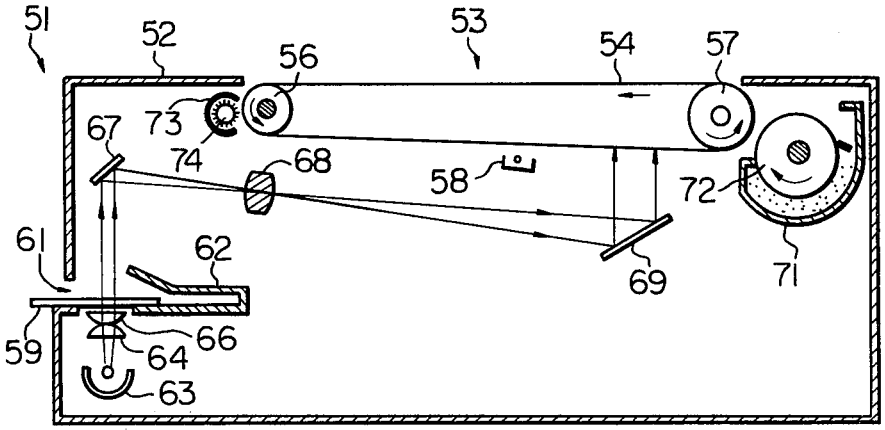
FIG. 2 is similar to FIG. 1 but shows a second embodiment of the invention.

FIG. 2 shows another visual display apparatus 51 embodying the present invention which comprises a housing 52 formed with an opening 53 in the upper wall thereof. An endless photoconductive belt 54 is trained around a drive roller 57 and an idler roller 56 and is oriented so that the photoconductive surface thereof faces outwardly. A corona charging unit 58 is disposed adjacent to the lower run of the belt 54 to electrostatically charge the same.

An original document 59 which is here in the form of a transparency such as a microfilm frame or microfiche is inserted into the housing 52 through an opening 61 and is supported on a rest 62. An illumination lamp 63 illuminates the document 59 through the back or from below as viewed in FIG. 2. Condensor lenses 64 and 66 are provided between the lamp 63 and the document 59.

An optical image of the document 59 is reflected from a plane mirror 67 through a converging lens 68 which focusses the image onto the belt 54. Another plane mirror 69 is provided in the optical path of the image. The image of the document 59 is much larger than the document 59 itself as in the previous embodiment.

However, the document 59 is smaller than the document 28 and the imaging operation does not involve scanning. Instead, the belt 54 is stopped and the light image is radiated thereonto in its entirety. After the electrostatic image is formed, the rollers 56 and 57 and thereby the belt 54 are rotated counterclockwise so that the elctrostatic image is developed by means of a developing unit 71 comprising a magnetic brush 72. Further movement of the belt 54 brings the image portion thereof into alignment with the opening 53 so that the viewers may view the visible toner image on the belt 54 therethrough. Of course, the belt 54 is stopped when the image portion thereof reaches the opening 53. After viewing, the belt 54 is rotated further counterclockwise and the toner substance is removed therefrom by a cleaning unit 73 which typically comprises another magnetic brush 74. The belt 54 is then ready for the display of another image.

If desired, the cost of the apparatus 51 may be reduced by eliminating the cleaning unit 73. In this case, the magnetic brush 72 of the developing unit 71 also serves to erase the visible image from the belt 54. Such an embodiment requires that the belt 54 be rotated by two revolutions for one display operation.

Figure 3:
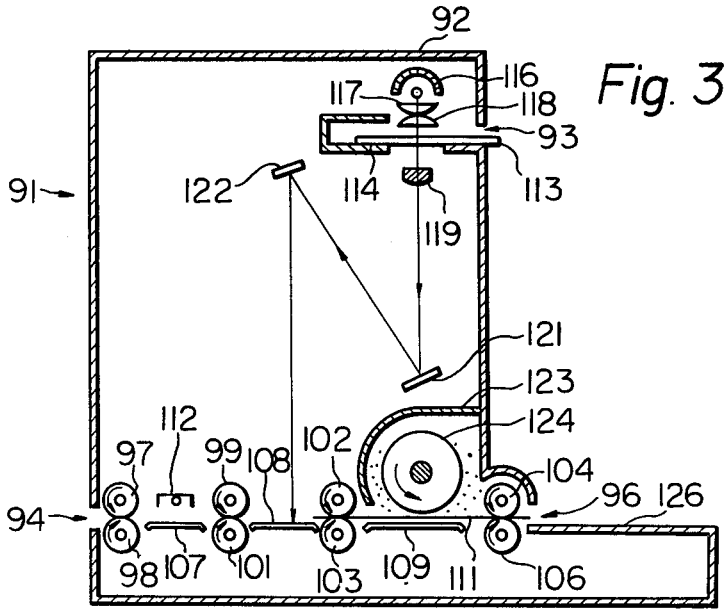
FIG. 3 is also similar to FIG. 1 but shows a third embodiment of the invention.

FIG. 3 shows another visual display apparatus 91 embodying the present invention which comprises a housing 92 formed with opening 93, 94 and 96. Rotatably drivably supported within the housing 92 are feed rollers 97, 98, 99, 101, 102, 103, 104 and 106. A guide 107 is disposed between the feed rollers 97, 98 and 99, 101. Another guide 108 is disposed between the feed rollers 99, 101 and 102, 103. Yet another guide 109 is provided between the feed rollers 102, 103 and 104, 106.

A photoconductive sheet 111 comprising, for example, a stiff paper substrate formed with a photoconductive layer on one side thereof is inserted into the bite of the feed rollers 97 and 98 through the opening 94 with the photoconductive layer facing upwardly. The sheet 111 is fed by the feed rollers 97 and 98 over the guide 107 into the bite of the feed rollers 99 and 101 which in turn feed the sheet 111 over the guide 108 into the bite of the feed rollers 102 and 103. A corona charging unit 112 disposed above the guide 107 serves to electrostatically charge the sheet 111.

An original document 113 in the form of a transparency is inserted into the housing 92 through the opening 93 and supported on a rest 114. An illumination lamp 116 illuminates the document 113 from the back (from above). Condenser lenses 117 and 118 are provided between the lamp 116 and document 113. An optical image of the document 113 is focussed by a converging lens 119 onto the sheet 111 by way of plane mirrors 121 and 122. The feed rollers are stopped so that the sheet 111 is held stationary above the guide 108 for imaging. A developing unit 123 comprising a magnetic brush 124 is disposed above the guide 109. After an electrostatic image of the document 113 is formed on the sheet 111, the sheet 111 is fed over the guide 109 into the bite of the feed rollers 104 and 106 and the electrostatic image is developed to provide a visible toner image.

The feed rollers 104 and 106 feed the sheet 111 out the opening 96 onto a table 126 which is constituted by part of the housing 92. The visible image on the sheet 111 may then be viewed as desired.

It is preferred that the sheet 11 not be completely discharged from the housing 92 for viewing but that the feed rollers 104 and 106 be stopped when all but the trailing edge portion of the sheet 111 clears the feed rollers 104 and 106. The trailing edge portion, in FIG. 3 the left edge portion, of the sheet 111 remains in the bite of the feed rollers 104 and 106 as the visible image on the sheet 11 is viewed. After the image has been viewed sufficiently, the feed rollers 104 and 106 are driven in reverse to feed the sheet 111 back into the housing 92. During passage through the housing 92, the magnetic brush 124 removes the toner substance from the sheet 111. The sheet 111 is fed leftwardly until only the right edge portion thereof is gripped by the feed rollers 97 and 98. The feed rollers are then stopped and the sheet 111 is ready for the display of an image of another document.

The apparatus 91 is especially adaptable to a low cost application since the sheet 111 may be produced much more cheaply than the belts 16 and 54.

It is to be appreciated that an electrostatic image may be initially formed on a photoconductive drum, belt or sheet, transferred to an electrically insulative medium in the form of belt or sheet, and thereafter developed by a developing unit to produce a visible toner image. Further, a photoconductive toner substance may be incorporated into any of the embodiments which eliminate the need for a charging unit.

Many modifications will become possible for those skilled in the art after receiving the teachings of the present disclosure without departing from the scope thereof.

What is claimed is:

1. A display apparatus for producing an enlarged, erasable display of an original document, said apparatus comprising:

a supply roller and a take-up roller;

a photoconductive member comprising a belt wound at opposite ends thereof around the supply roller and the take-up roller respectively;

first and second idler rollers spaced between the supply and take-up rollers along the length of the belt;

charging means for electrostatically charging the photoconductive member;

projector means for projecting a light image of the original document onto the photoconductive member to form an electrostatic image thereon;

developing means for applying a toner substance to the photoconductive member to produce a visible toner image thereon;

drive means connected to rotate the supply and take-up rollers for moving the phtotconductive member to a viewing position for viewing the visible image, the viewing position being between the first and second idler rollers along the length of the belt, at least one of the first and second idler rollers being movable to vary the distance between the first and second idler rollers; and erasing means for erasing the visible image from the photoconductive member.

2. A display apparatus as in claim 1, in which the developing means comprises a magnetic brush.

3. A display apparatus as in claim 1, in which the projector means comprises a converging lens.

4. A display apparatus as in claim 1, further comprising feed means for feeding the original document relative to the projector means in synchronism with the movement of the belt.

5. A display apparatus as in claim 1, in which the erasing means comprises the magnetic brush.

* * * * *

UNITED STATES PATENT AND TRADEMARK OFFICE

CERTIFICATE OF CORRECTION

PATENT NO. : 4,136,943

DATED : January 30, 1979

INVENTOR(S) : Yutaka KOIZUMI

It is certified that error appears in the above-identified patent and that said Letters Patent are hereby corrected as shown below:

Add the following to the heading:

--Assignee: Ricoh Company Ltd.,

Tokyo, Japan--.

Signed and Sealed this

*First* Day of *May 1979*

[SEAL]

*Attest:*

RUTH C. MASON
*Attesting Officer*

DONALD W. BANNER
*Commissioner of Patents and Trademarks*